US007093466B1

(12) United States Patent
Chen

(10) Patent No.: US 7,093,466 B1
(45) Date of Patent: Aug. 22, 2006

(54) HIGH-SPEED HIGH-STAND FABRIC TAKE-UP DEVICE WITH UNIFORM FABRIC TAUTNESS ARRANGEMENT

(75) Inventor: Shih-Chi Chen, Taipei Hsien (TW)

(73) Assignee: PAI Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 11/142,347

(22) Filed: Jun. 2, 2005

(51) Int. Cl.
*D04B 15/88* (2006.01)

(52) U.S. Cl. ..... 66/153

(58) Field of Classification Search ..... 66/147, 66/149 R, 150–153; 242/520, 534, 535.5, 242/541

See application file for complete search history.

(56) References Cited

U.S. PATENT DOCUMENTS 3,472,048 A * 10/1969 Shaw et al. ..... 66/147
3,850,012 A * 11/1974 Bourgeois ..... 66/151
4,055,968 A * 11/1977 Bourgeois ..... 66/151
6,557,381 B1 * 5/2003 Reester ..... 66/153
6,637,241 B1 * 10/2003 Wang ..... 66/151

* cited by examiner

*Primary Examiner*—Danny Worrell
(74) *Attorney, Agent, or Firm*—Birch, Stewart Kolasch & Birch LLP

(57) ABSTRACT

Provided is a high-speed high-stand device for taking up fabric comprising two side boxes each including a projection formed on its side proximate top; a take-up shaft provided across intermediate portions of the side boxes, the take-up shaft being adapted to wind fabric therearound; and a friction mechanism including two arms each having the other end pivotably connected to the projection, and a friction rod fixedly interconnected one ends of the arms, the friction rod being provided above the take-up shaft to contact the fabric wound therearound. In a fabric take-up process, an angle from an initial position of the arms to an operating position thereof is limited as a diameter of the fabric is increasing, and a pressing force exerted by the friction rod on the fabric being wound around the take-up shaft is the same for obtaining a uniform tautness of the wound fabric.

8 Claims, 7 Drawing Sheets

HIGH-SPEED HIGH-STAND FABRIC TAKE-UP DEVICE WITH UNIFORM FABRIC TAUTNESS ARRANGEMENT

FIELD OF THE INVETNION

The present invention relates to fabric take-up devices and more particularly to a high-speed high-stand fabric take-up device having an arrangement for applying same pressing force on fabric being wound around a take-up shaft such that a fabric roll with uniform tautness can be obtained around the shaft.

BACKGROUND OF THE INVENTION

In a knitting machine, a take-up device is typically employed to wind fabric in rolls. One type of take-up device can wind fabric in rolls having a diameter of about 20 inches. It is not widely employed due to its small capacity. The other type of take-up device, as the widely employed one due to it high capacity, can wind fabric rolls having a diameter of about 46 inches (i.e., fabric weight more than 100 kg). However, for the latter one centrifugal force increases as fabric is winding on a take-up shaft. Further, fabric is pliable in nature. Thus, fabric tends to throw away in the winding process.

U.S. Pat. No. 6,637,241 entitled "Fabric Take-Up Apparatus" aims at solving the above problem. However, the patent still has a drawback as detailed below by referring to FIGS. 1A and 1B. The fabric take-up apparatus 100 comprises two sets of friction mechanisms 110. Each friction mechanism 110 has two operating arms 112 each having axles 112*a* and 112*b* both at the same side of and above an axis of the shaft 120 for taking up fabric. A virtual line from one operating arm 112 to the other operating arm 112 is about perpendicular to a virtual line extended upward from the axis of the shaft 120 in the fabric winding process. Initially, force applied on the fabric 10 is provided by weight of the edge of the friction rods 111. Further, the extent of the perpendicularity is almost 90 degrees as fabric 10 continues to wind around the shaft 120 (i.e., diameter of fabric 10 increases). At this time, force applied on the fabric 10 is provided by weight of the whole friction rods 111. Thus, force applied on the fabric 10 is not constant in the fabric winding process. In fact, force applied on the fabric 10 is increasing in the process. For solving this problem, a balancing weight mechanism 130 is provided below the shaft 120. The balancing weight mechanism 130 is adapted to provide same pressing force on the fabric 10 being wound. However, the provision of friction mechanisms 110 and balancing weight mechanism 130 may inevitably increase the manufacturing cost and complicate the components of the fabric take-up apparatus 100. Thus, the need for improvement still exists.

SUMMARY OF THEE INVENTION

It is therefore an object of the present invention to provide a high-speed high-stand fabric take-up device. In a fabric take-up process, an angle of a friction rod from its initial inoperative position to its maximum operating position is much less than that of the prior art. This is because the weight of the whole friction rod is applied on fabric being wound around a take-up shaft while diameter of fabric is increasing. Further, pressing force exerted by the friction rod on fabric is the same during the fabric take-up process. As a result, a fabric roll with uniform tautness is obtained.

Moreover, the constituent components of the fabric take-up device are simplified, resulting in a reduction in its manufacturing cost.

The above and other objects of the present invention are realized by providing a device for taking up fabric from a knitting machine comprising two side boxes each including a projection formed on its side proximate top; a take-up shaft disposed across intermediate portions of the side boxes, the take-up shaft being adapted to wind fabric therearound; and a friction mechanism of U-shaped including two arms each having the other end pivotably connected to the projection, and a friction rod fixedly interconnected one ends of the arms, the friction rod being disposed above the take-up shaft to contact the fabric wound therearound, wherein in a fabric take-up process, an angle from an initial inoperative position of the arms to a maximum operating position thereof is limited to a predetermined range as a diameter of the fabric is increasing, and a pressing force exerted by the friction rod on the fabric being wound around the take-up shaft is the same during the fabric take-up process.

The above and other objects, features and advantages of the present invention will become apparent from the following detailed description taken with the accompanying drawings.

DETAILED DESCRIPTION OF THE PREFERRED EMBODIMENTS

Figure 2:
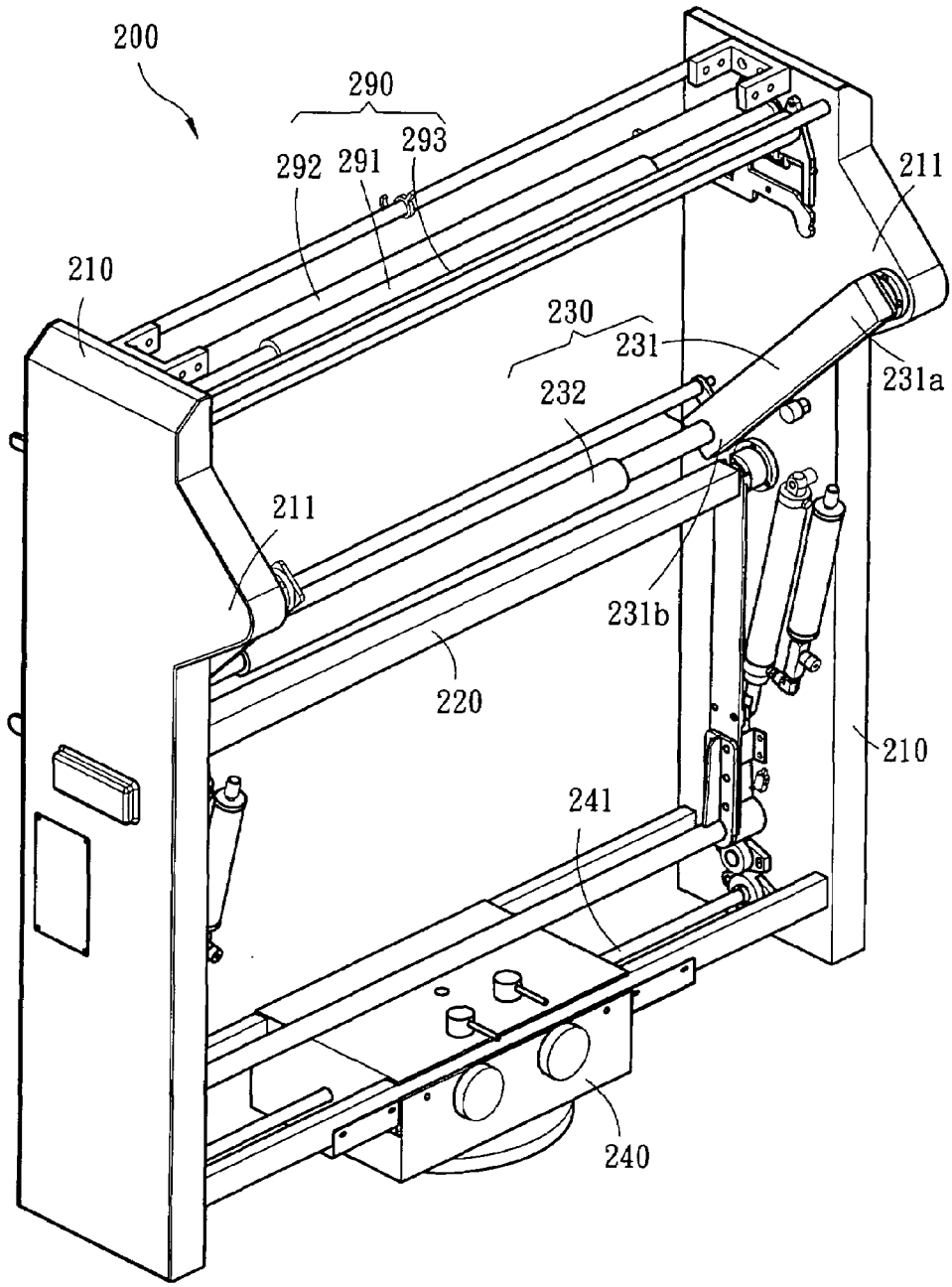
FIG. 2 is a perspective view of a preferred embodiment of high-speed high-stand fabric take-up device according to the invention.
Figure 3:
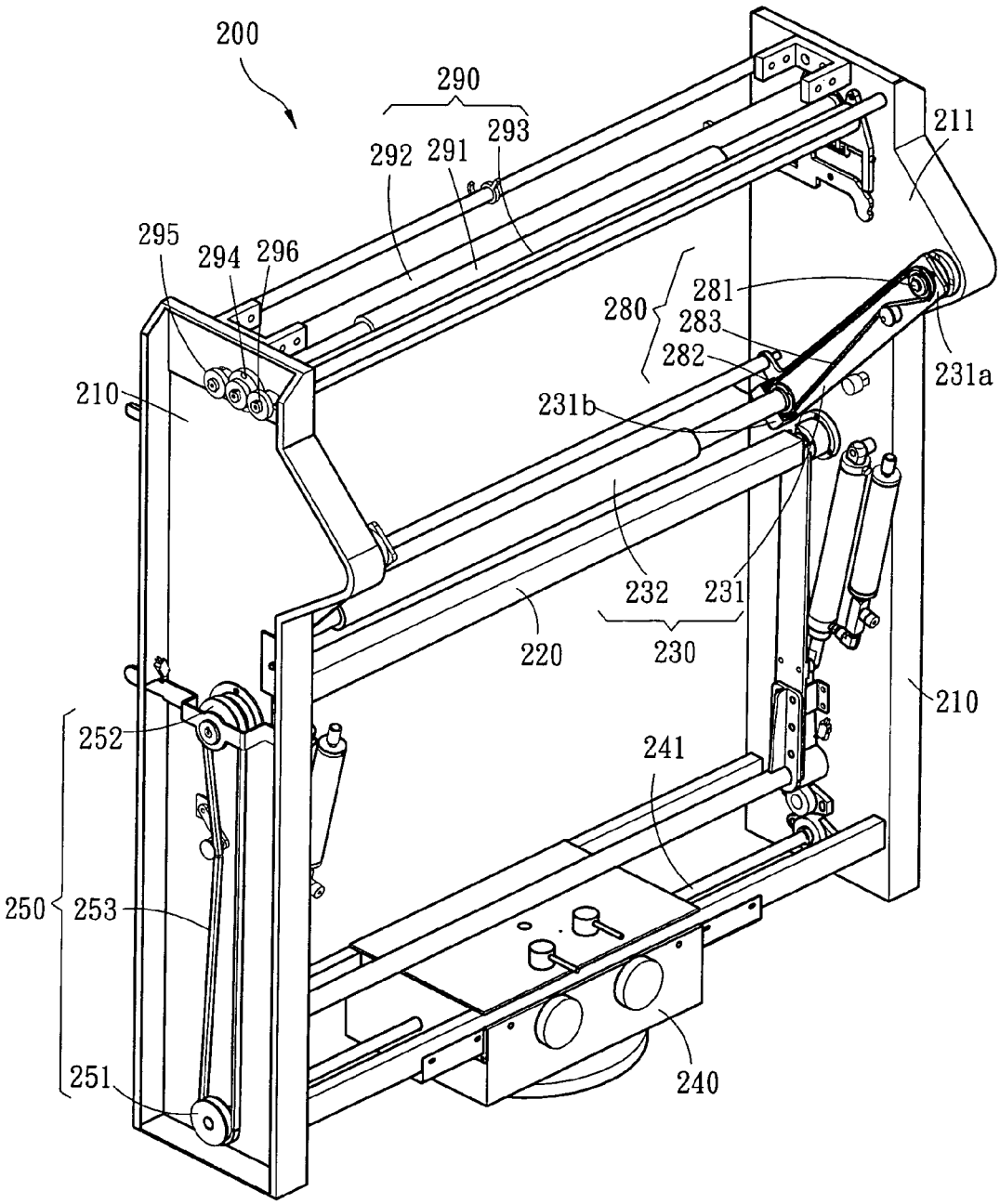
FIG. 3 is a view similar to FIG. 2 with covers of certain components removed for showing details therein.
Figure 4:
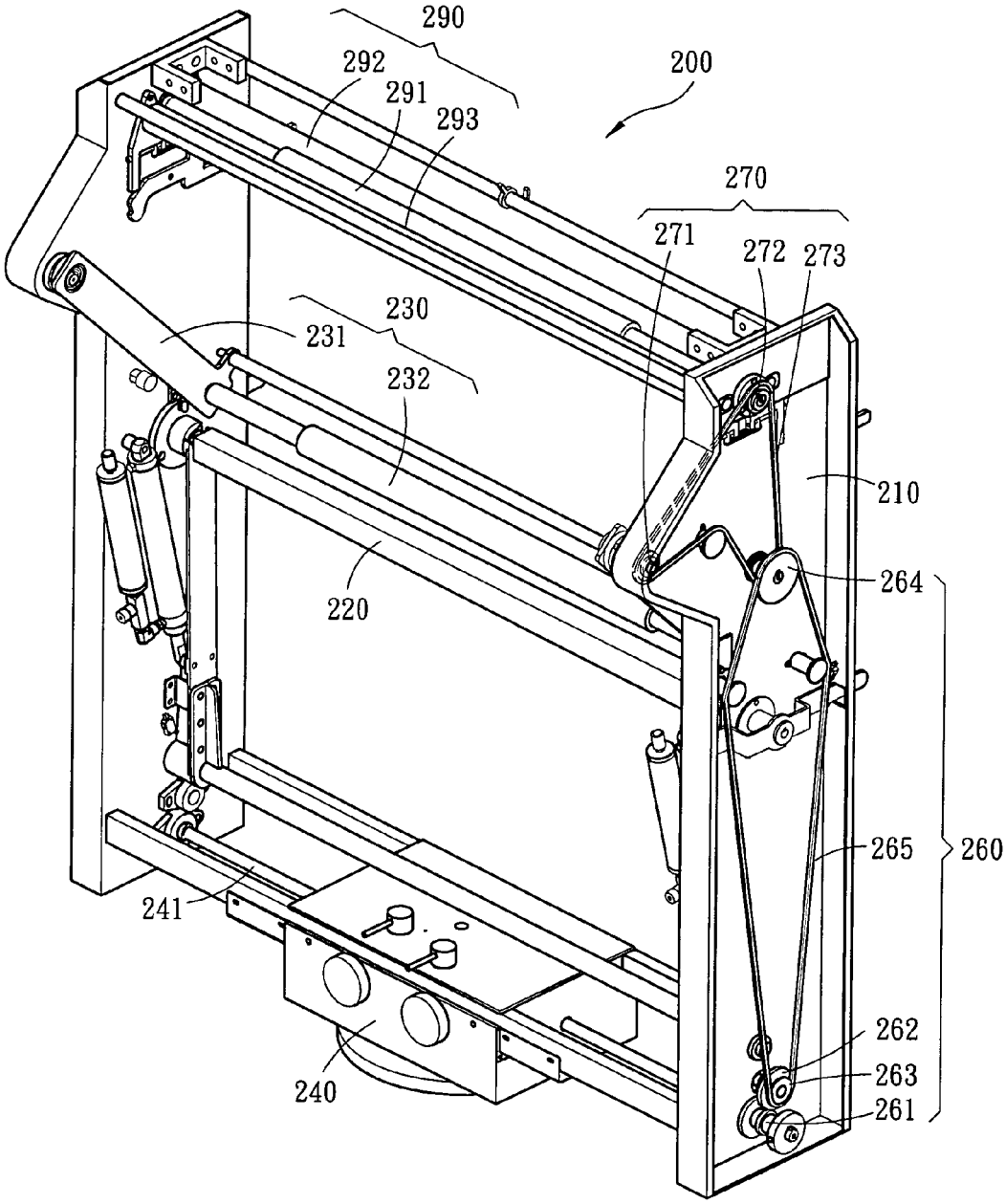
FIG. 4 is a view similar to FIG. 3 viewed from an opposite direction.

Referring to FIGS. 2, 3 and 4, a high-speed high-stand fabric take-up device 200 of high capacity in accordance with a preferred embodiment of the invention comprises two side boxes 210, a take-up shaft 220, a friction mechanism 230, a speed change mechanism 240, a first transmission assembly 250, a second transmission assembly 260, a third transmission assembly 270, a fourth transmission assembly 280, and a supply mechanism 290. Each component is discussed in detail below.

Please refer to FIG. 2. A triangular projection 211 is formed on a side of the side box 210 proximate its top. The take-up shaft 220 is provided across intermediate portions of the side boxes 210. The take-up shaft 220 is adapted to wind fabric therearound. The friction mechanism 230 is of U-shaped and comprises two arms 231 each having the other end 231*a* pivotably connected to the projection 211, and a friction rod 232 fixedly interconnected one ends 231*b* of the arms 231. The friction rod 232 is disposed above the take-up shaft 220 to contact the fabric wound therearound.

Please refer to FIGS. 2 and 3. The speed change mechanism 240 is provided at a lower portion of the fabric take-up device 200 between bottoms of the side boxes 210. The speed change mechanism 240 comprises a driving shaft 241 extended therethrough. Both ends of the driving shaft 241 are extended into the side boxes 210. The first transmission assembly 250 is provided in one side box 210 and comprises lower and upper wheels 251 and 252, and a belt 253 running around the wheels 251 and 252. The lower wheel 251 is fixedly connected to one end of the driving shaft 241 and the upper wheel 252 is fixedly connected to one end of the take-up shaft 220. The speed change mechanism 240 is adapted to activate for rotating the driving shaft 241 and the lower wheel 251. Also, the upper wheel 252 turns by running the belt 253. As a result, the take-up shaft 220 rotates. It is obvious to those skilled in the art that tautness of fabric wound around the take-up shaft 220 can be adjusted by adjusting the rotating speed of the take-up shaft 220. Also, adjustment of the rotating speed of the take-up shaft 220 can be carried out by controlling the speed change mechanism 240 and which is known in the art. Accordingly, further description thereof is omitted for purposes of brevity and convenience.

Please refer to FIGS. 3 and 4. The supply mechanism 290 is provided across upper portions of the side boxes 210 and comprises a drive shaft 291 and two driven shafts 292 and 293. The second transmission assembly 260 and the third transmission assembly 270 are provided in the other side box 210. The fourth transmission assembly 280 is provided in the arm 231 proximate the other side box 210. The speed change mechanism 240 is adapted to transmit motive force to the friction rod 232 through the second transmission assembly 260. Also, the speed change mechanism 240 is adapted to transmit motive force to the drive shaft 291 and the driven shafts 292 and 293 through the second transmission assembly 260 and the third transmission assembly 270.

The second transmission assembly 260 comprises four wheels 261, 262, 263, and 264, and a belt 265 running around the wheels 263 and 264. The wheel 261 is fixedly connected to the other end of the driving shaft 241. The wheels 262 and 263 are adapted to co-rotate. The wheel 262 is driven by the wheel 261. The wheel 264 is provided in a position higher than the take-up shaft 220.

The third transmission assembly 270 comprises two wheels 271 and 272, and a belt 273 running around the wheels 271, 272, and 264. The wheel 271 is fixedly connected to the other end 231*a* of the arm 231. The wheel 272 is fixedly connected to the other end 231*a* of the drive shaft 291. Thus, the third transmission assembly 270 can be driven as the second transmission assembly 260 drives. The fourth transmission assembly 280 comprises two wheels 281 and 282, and a belt 283 running around the wheels 281 and 282. The wheel 281 is fixedly connected to the other end 231*a* of the arm 231. The wheel 282 is fixedly connected to one end 231*b* of the arm 231 joining the friction rod 232. Thus, the fourth transmission assembly 280 can be driven as the third transmission assembly 270 drives.

In operation, the speed change mechanism 240 can drive the driving shaft 241 to move the second transmission assembly 260, the third transmission assembly 270, and the fourth transmission assembly 280. The speed change mechanism 240 transmits motive force to the friction rod 232 through the second transmission assembly 260. Also, the speed change mechanism 240 transmits motive force to the drive shaft 291 through the second transmission assembly 260 and the third transmission assembly 270. Either end of the drive shaft 291 is formed as a drive wheel 294, either end of the driven shaft 292 is formed as a driven wheel 295, and either end of the driven shaft 293 is formed as a driven wheel 296 respectively. Also, the drive wheel 294 has two opposite points on its periphery to be in contact with the driven wheels 295 and 296. Thus, the driven wheels 295 and 296 can be driven as the drive wheel 294 rotates. Also, the driven shafts 292 and 293 can be driven as the drive shaft 291 rotates. By configuring as above, fabric, fed from a source (e.g., knitting machine (not shown)) can be conveyed from the drive shaft 291 to either driven shaft 292 or 293 prior to sending to the take-up shaft 220 for take-up.

Figure 1A:
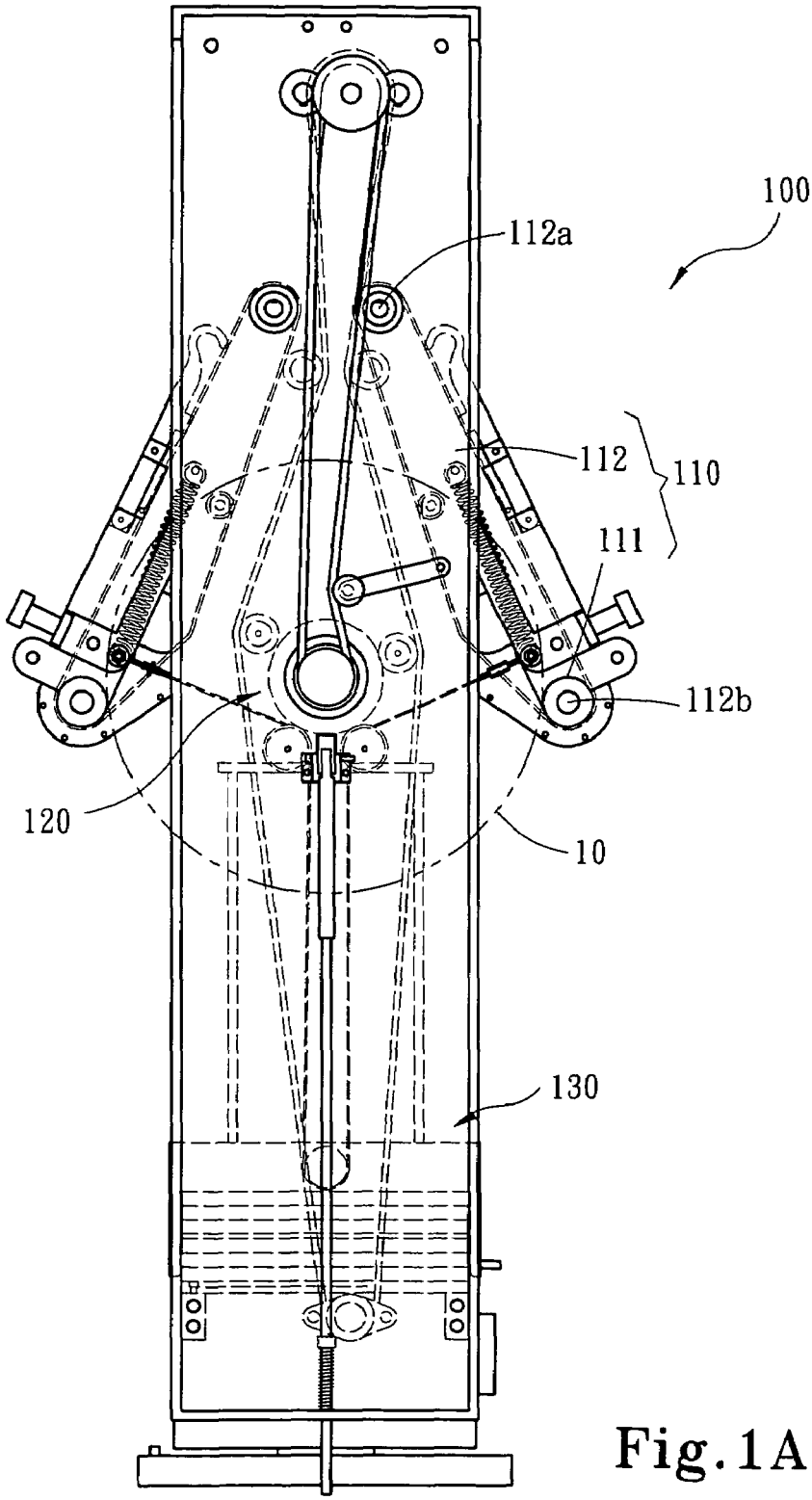
Fig.1A PRIOR ART
FIGS. 1A and 1B are schematic side views of a conventional fabric take-up apparatus in its initial and full operating positions respectively.
Figure 1B:
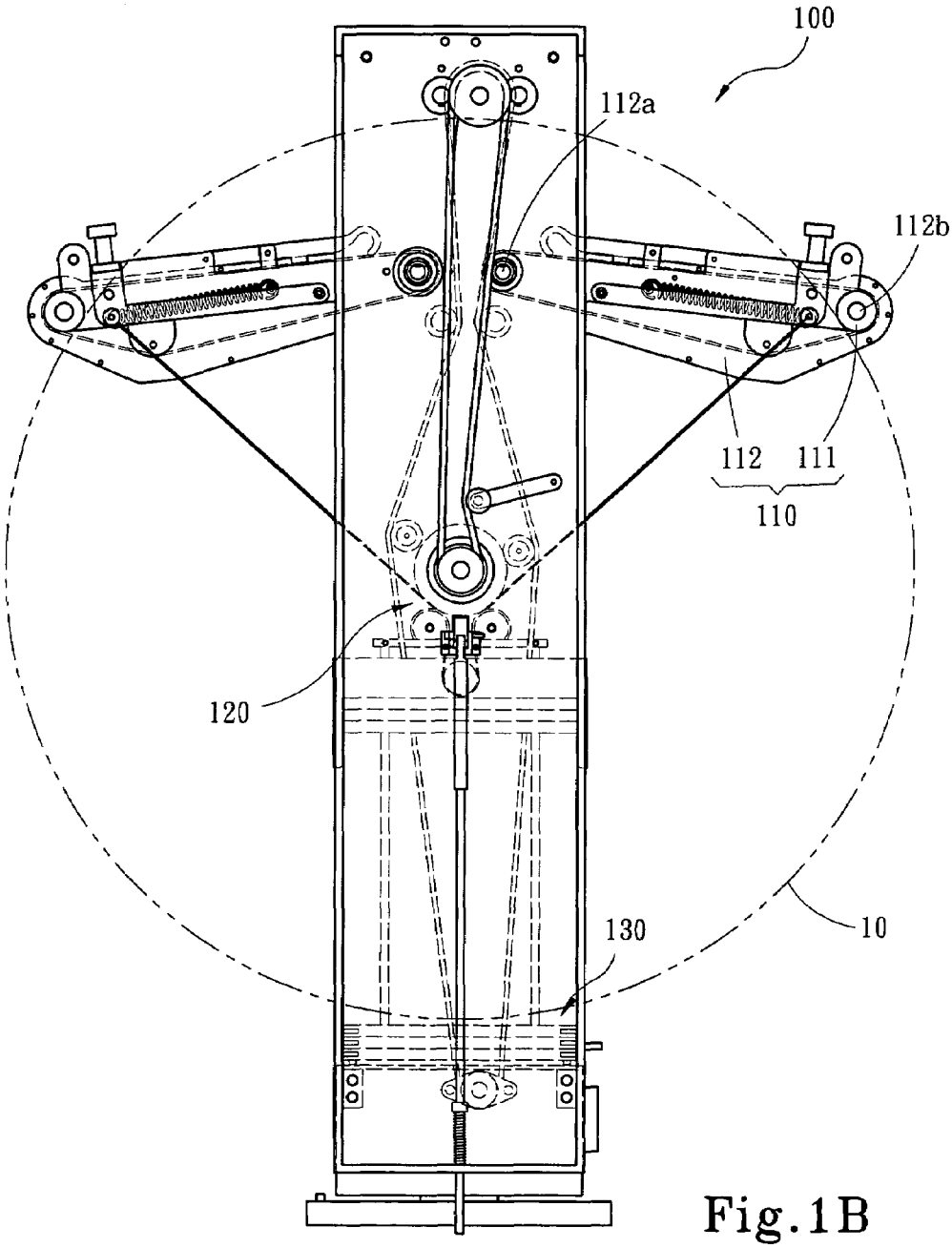
Fig.1B PRIOR ART
Figure 5A:
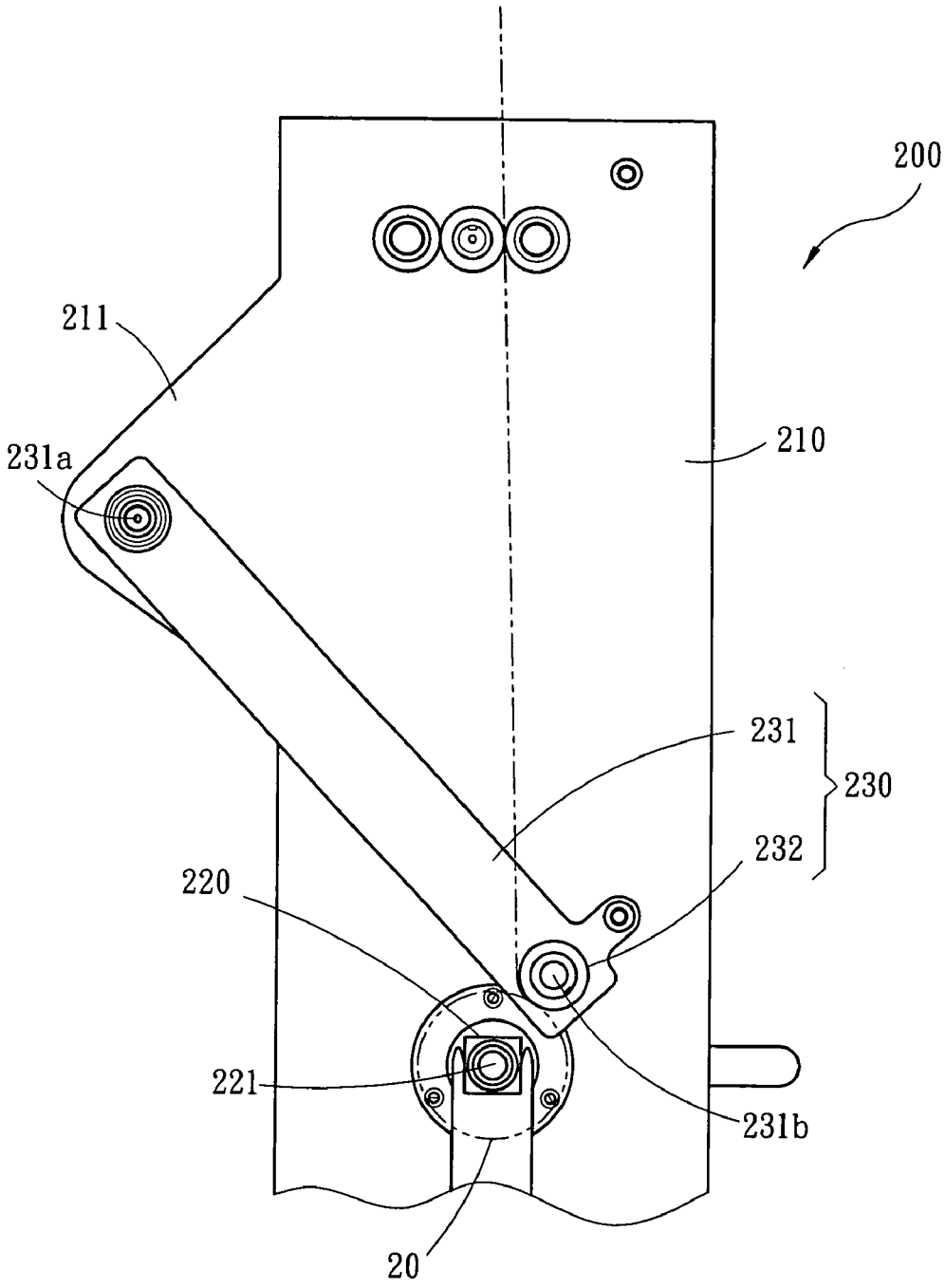
FIGS. 5A and 5B are side views schematically showing initial and full operating positions of the fabric take-up device respectively.
Figure 5B:
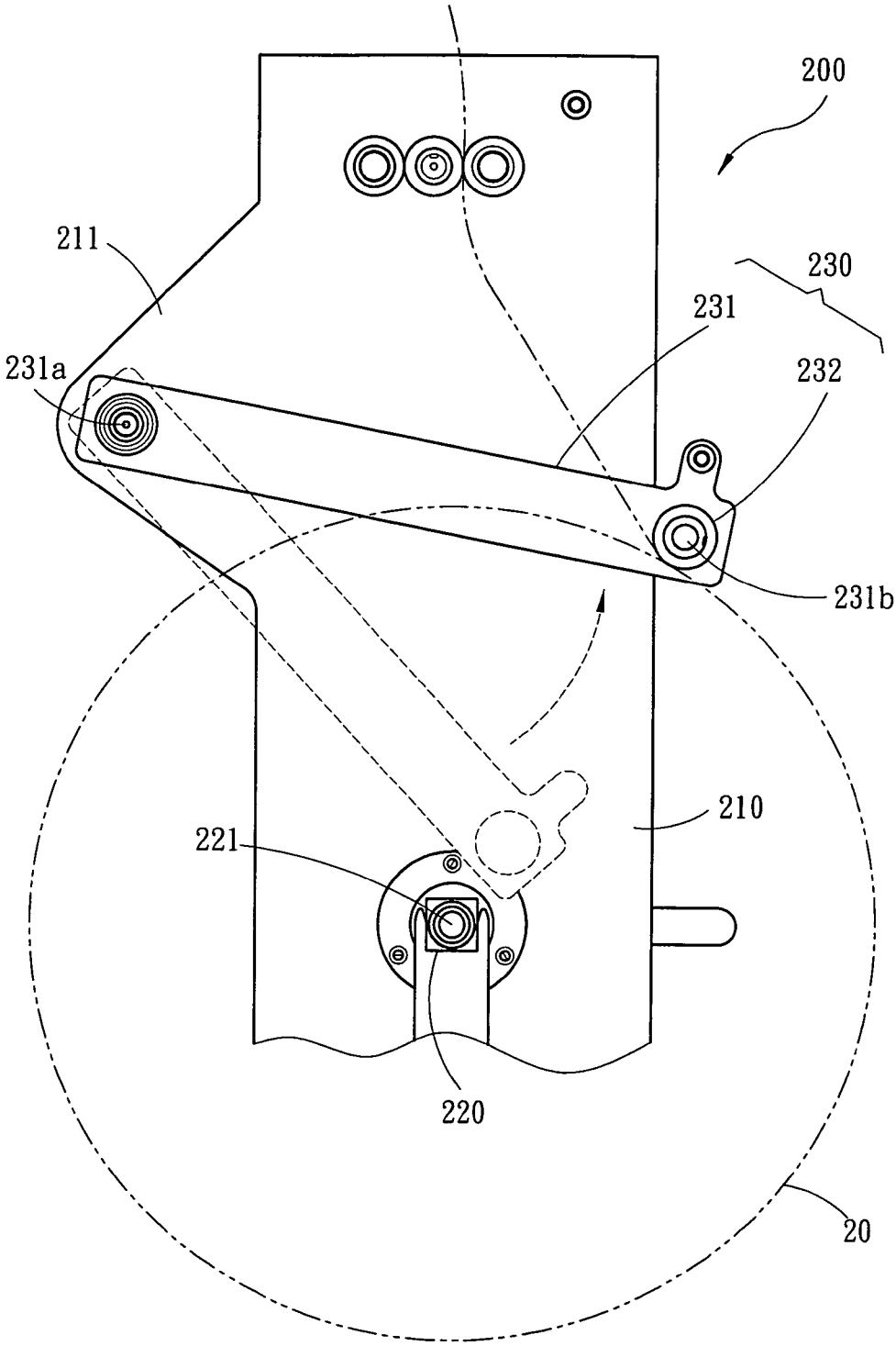

Referring to FIGS. 5A and 5B, as stated above the arms 231 are provided above the take-up shaft 220. Also, each arm 231 has the other end 231*a* pivotably connected to the projection 211 and the take-up shaft 220 has an axis 221 fixedly interconnected one ends 231*b* of the arms 231. Thus, an angle of the friction rod 232 from its initial inoperative position in FIG. 5A to its maximum operating position in FIG. 5B is less than that of the prior art discussed in FIGS. 1A and 1B. This is because the weight of the whole friction rod 232 is applied on fabric 20 while diameter of fabric 20 is increasing in the fabric take-up process. Further, pressing force exerted by the friction rod 232 on fabric 20 being wound around the take-up shaft 220 is the same during the fabric take-up process. As a result, a fabric roll with uniform tautness is obtained.

As compared with the prior art, in the invention a balancing weight mechanism is eliminated. Also, only one friction mechanism 230 is provided. Thus, the constituent components of the fabric take-up device 200 are simplified, resulting in a reduction in its manufacturing cost.

While the invention herein disclosed has been described by means of specific embodiments, numerous modifications and variations could be made thereto by those skilled in the art without departing from the scope and spirit of the invention set forth in the claims.

What is claimed is:

1. A device for taking up fabric from a knitting machine comprising:

two side boxes each including a projection formed on its side proximate top;

a take-up shaft disposed across intermediate portions of the side boxes, the take-up shaft being adapted to wind fabric therearound; and a friction mechanism including two arms each having a first end pivotably connected to the projection, and a friction rod fixedly interconnected to second ends of the arms, the friction rod being disposed above the take-up shaft to contact the fabric wound therearound and to apply a pressing force by a weight of the friction rod to the fabric wound around the take-up shaft, wherein in a fabric take-up process, the arms move from an initial position where the take-up shaft is empty to a maximum position where the take-up shaft is full due to an increase in the diameter of the fabric on the take-up shaft, and the pressing force exerted by the friction rod on the fabric being wound around the take-up shaft is the same during the fabric take-up process.

2. The device of claim 1, further comprising a speed change mechanism disposed between bottoms of the side boxes and a first transmission assembly disposed in one side box, the first transmission assembly being driven by the speed change mechanism for rotating the take-up shaft.

3. The device of claim 2, wherein the speed change mechanism comprises a driving shaft extended therethrough and having both ends extended into the side boxes, and wherein the first transmission assembly is disposed in one side box and comprises a lower wheel fixedly connected to one end of the driving shaft, an upper wheel fixedly connected to one end of the take-up shaft, and a belt running around the lower and the upper wheels.

4. The device of claim 2, further comprising a supply mechanism disposed across upper portions of the side boxes, the supply mechanism including a drive shaft and two driven shafts and, wherein the second transmission assembly and the third transmission assembly are disposed in the other side box, wherein the fourth transmission assembly is disposed in the arm proximate the other side box, and wherein the speed change mechanism is adapted to transmit motive force to the friction rod through the second transmission assembly and to the drive shaft and the driven shafts and through the second transmission assembly and the third transmission assembly respectively.

5. The device of claim 4, wherein the second transmission assembly comprises a first wheel fixedly connected to the other end of the driving shaft, a second wheel driven by the first wheel, a third wheel being adapted to co-rotate with the second wheel, a fourth wheel disposed in a position higher than the take-up shaft, and a belt running around the third and the fourth wheels.

6. The device of claim 5, wherein the third transmission assembly comprises a fifth wheel fixedly connected to the first end of the arm, a sixth wheel fixedly connected to the other end of the drive shaft, and a belt running around the fifth, the sixth, and the fourth wheels such that the third transmission assembly is adapted to drive as the second transmission assembly drives.

7. The device of claim 6, wherein either end of the drive shaft is formed as a drive wheel, either end of the first driven shaft is formed as a first driven wheel, either end of the second driven shaft is formed as a second driven wheel respectively, and the drive wheel has two opposite points on its periphery to be in contact with the first and the second driven wheels and such that the first and the second driven wheels and are adapted to drive as the drive wheel rotates, and the first and the second driven shafts and are adapted to drive as the drive shaft rotates.

8. The device of claim 6, wherein the fourth transmission assembly comprises a seventh wheel fixedly connected to the first end of the arm, an eighth wheel fixedly connected to the second end of the arm joining the friction rod, and a belt running around the seventh and the eighth wheels and such that the fourth transmission assembly is adapted to drive as the third transmission assembly drives.

* * * * *